US006798125B2

(12) United States Patent
Sugiyama et al.

(10) Patent No.: US 6,798,125 B2
(45) Date of Patent: Sep. 28, 2004

(54) SPARK PLUG HAVING GROUND ELECTRODE MADE OF NI ALLOY AND NOBLE METAL WEAR RESISTANT PORTION

(75) Inventors: Yoshihisa Sugiyama, Gifu (JP); Yoshitaka Sugiura, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/283,186

(22) Filed: Oct. 30, 2002

(65) Prior Publication Data

US 2003/0085644 A1 May 8, 2003

(30) Foreign Application Priority Data

Oct. 31, 2001 (JP) ..... 2001-335352

(51) Int. Cl.[7] ..... H01T 13/20

(52) U.S. Cl. ..... 313/141; 313/142; 313/144; 313/118; 445/7

(58) Field of Search ..... 313/141, 139, 313/140, 118

(56) References Cited

U.S. PATENT DOCUMENTS 5,811,915 A * 9/1998 Abe et al. ..... 313/141

6,078,129 A * 6/2000 Gotou et al. ..... 313/141

FOREIGN PATENT DOCUMENTS

| | | | | |
|---|---|---|---|---|
| EP | 1 237 244 A2 | | 9/2002 | |
| JP | 03098279 A | * | 4/1991 | ..... H01T/13/39 |
| JP | 07268522 A | * | 10/1995 | ..... C22C/19/05 |
| JP | 2001273965 A | * | 10/2001 | ..... H01T/13/20 |

* cited by examiner

*Primary Examiner*—Ashok Patel
*Assistant Examiner*—Sikha Roy
(74) *Attorney, Agent, or Firm*—Sughrue Mion, PLLC

(57) ABSTRACT

In a spark plug (100), at least one side face of the ground electrode (4) is made of an electrode base material comprising an Ni alloy containing 21–25% by mass of Cr, 1–2% by mass of Al, 7–20% by mass of Fe and 58–71% by mass of Ni. The noble metal wear resistant portion (32) is joined to the electrode base material via a welding portion (W). When the linear expansion coefficients at 800 K of the noble metal constituting the noble metal wear resistant portion (32) and the electrode base material are represented by $\alpha 1$ and $\alpha 2$, respectively, $\Delta\alpha \equiv \alpha 2 - \alpha 1$ is adjusted to be $4.55 \times 10^{-6}$/K or less. The outer diameter of the noble material wear resistant portion (32) is set from 0.6 mm to 1.5 mm.

4 Claims, 2 Drawing Sheets

SPARK PLUG HAVING GROUND ELECTRODE MADE OF NI ALLOY AND NOBLE METAL WEAR RESISTANT PORTION

BACKGROUND OF THE INVENTION

1. Field of the Invention

The present invention relates to a spark plug for use in an internal combustion engine.

2. Description of the Related Art

Ordinarily, in spark plugs, many proposals for enhancing resistance to wear due to sparks, in which a noble metal chip mainly made of Pt, Ir or the like is welded on the front end of an electrode to form an wear resistant portion have been made. Particularly, the wear resistant portion on the part of a center electrode which, in many cases, is set to be negative polarity at the time of discharging a spark is liable to be subjected to a strong attack of the spark and be worn down, so that a noble metal has increasingly been used for this portion.

On the other hand, in regard to an internal combustion engine, a lean-burn method has increasingly been adopted as seen in direct fuel injection engines, to comply with strict exhaust gas control regulations. Also, in order to obtain optimum combustion, a configuration in which the spark discharge gap of the spark plug protrudes further inside a combustion chamber than an ordinary spark plug has increasingly been adopted. As a result, the electrodes of the spark plug, in particular the ground electrode which is located further inside the combustion chamber, is subjected to severe high temperature conditions. Therefore, it is an important task to improve heat resistance and spark wear resistance of the ground electrode and, accordingly, not only formation of a noble metal spark emitting portion but also changing the material of the electrode itself to a metal that has a higher heat resistance has been attempted. For example, Inconel 600 (trade name; available from Inco Ltd., in the U.K.), a Ni-based heat resistant alloy, has ordinarily been adopted as the material for the ground electrode, but adoption of Inconel 601 which has higher proportions of Cr and Fe and to which Al is also added to have a further enhanced high temperature strength and high temperature oxidation resistance is under consideration.

Heretofore, there are many cases in which a noble metal wear resistant portion of a ground electrode is formed by joining a noble metal chip to the ground electrode by means of resistance welding. However, the present inventors' studies have found that, when the noble metal chip having a high melting point was resistance welded to a heat resistant alloy of higher grade such as Inconel 601 or the like, it was difficult to sufficiently ensure joining strength by resistance welding under the above-described severe use environment. Specifically, when the noble metal wear resistant portion is subjected to a severe heat cycle while the spark plug is in actual use, the noble metal wear resistant portion is peeled away from the ground electrode so that normal ignition can not be performed.

Heat resistant alloys such as Inconel 601, in which the proportion of corrosion resistance-improving components such as Cr, Al or the like are increased, intrinsically have the tendency to decrease in weldability in direct proportion to an increase in oxidation resistance. Therefore, it may seem at first that the cause of the above-described decrease of joining strength is insufficient melting due to such a decrease of weldability, but the present inventors' research has found that the intrinsic cause is not insufficient melting.

SUMMARY OF THE INVENTION

It is therefore an object of the present invention to provide a spark plug in which, even when the ground electrode comprises a heat resistant alloy having an increased content of corrosion resistance improving component such as Cr, Al, the peeling resistance of a noble metal wear resistant portion welded to the ground electrode can sufficiently be ensured, whereupon the spark plug can be used for a long period of time even under severer working conditions.

A spark plug according to the present invention, in which a spark discharge gap formed by securing a noble metal wear resistant portion to the face of a ground electrode facing the front face of the center electrode, is characterized in that a portion containing at least the sides of the ground electrode comprises a Ni alloy containing from 21% by mass to 25% by mass of Cr, from 1% by mass to 2% by mass of Al, from 7% by mass to 20% by mass of Fe and from 58% by mass to 71% by mass of Ni, the noble metal wear resistant portion is joined to the side face of the ground electrode via a welding portion, $\Delta\alpha \equiv \alpha 2 - \alpha 1$ is adjusted to be $4.55\times10^{-6}$/K or less, wherein $\alpha 1$ represents the linear expansion coefficient at 800 K of the noble metal constituting the noble metal wear resistant portion; and $\alpha 2$ represents the linear expansion coefficient of the Ni alloy constituting a portion comprising the above-described side face of the ground electrode, and, further, the outer diameter of the noble metal wear resistant portion, which is defined as the diameter of the circle having the same surface area as that of an orthogonal projection of the noble metal wear resistant portion on a plane perpendicular to a center axis line of the center electrode, is from 0.6 mm to 1.5 mm.

In the above configuration, a raw material (hereinafter referred to as an electrode base material) composing a side face portion of the ground electrode which is subjected to high temperature particularly while the spark plug is in actual use is made to be a Ni alloy having the above-described composition which is excellent in high-temperature resistance and anti-oxidation property to a further extent than Inconel 600 or the like which has ordinarily been used. As a result, durability of the spark plug according to the present invention in a high temperature environment is enhanced and defects thereof such as corrosion, breakage or the like are less liable to occur.

Further, the present inventors have studied in detail factors affecting peeling resistance in the case where the noble metal wear resistant portion is joined to the electrode base material having the above composition, and it was clearly found that peeling is caused by a difference in the linear expansion coefficients of the noble metal constituting the wear resistant portion and the electrode base material rather than by insufficient melting due to decreased weldability of the electrode base material or the like. Accordingly, as a result of still further study it has been found that the peeling resistance of the noble metal wear resistant portion on the ground electrode can be enhanced to a great extent by adjusting $\Delta\alpha \equiv \alpha 2 - \alpha 1$ to be $4.55\times10^{-6}$/K or less, wherein $\alpha 1$ represents the linear expansion coefficient at 800 K of the noble metal constituting the noble metal wear resistant portion; and $\alpha 2$ represents the linear expansion coefficient at 800 K of the electrode base material.

However, it has been found that, under a use environment in which attainable temperature of the ground electrode is higher than ordinary, for example, during high speed or high load driving with a lean-burn or direct fuel injection engine, it is difficult to sufficiently ensure peeling resistance of the noble metal wear resistant portion only by adjusting such a difference $\Delta\alpha$ in linear expansion coefficients. To deal with this, the outer diameter of the noble metal wear resistant portion on the ground electrode as defined above is made to be from 0.6 mm to 1.5 mm, by which the peeling resistance can further be enhanced and the durability of the noble metal wear resistant portion can sufficiently be ensured even under such a severe use environment as described above.

As for the composition of the Ni alloy constituting the electrode base material, the Cr content can be from 21% by mass to 25% by mass. When the Cr content is less than 21% by mass, it is difficult to ensure desired high temperature oxidation resistance and high temperature strength. On the other hand, when the Cr content is over 25% by mass, ductility of the material is deteriorated whereupon impact resistance is deteriorated and, simultaneously, workability is deteriorated, causing an increase in production cost.

Further, Fe content can be from 7% by mass to 20% by mass. When the Fe content is less than 7% by mass, it is difficult to ensure desired high temperature strength. On the other hand, when the Fe content is over 20% by mass, the ductility of the material is deteriorated whereupon impact resistance is deteriorated and, simultaneously, workability is deteriorated, causing an increase in production cost.

Further, Al content can be from 1% by mass to 2% by mass. When the Al content is less than 1% by mass, it is difficult to ensure desired high temperature oxidation resistance. On the other hand, when the Al content is over 2% by mass, the ductility of the material is deteriorated due to formation of an intermetallic compound such as $Ni_3Al$ or the like so that impact resistance is deteriorated and, simultaneously, workability is deteriorated, causing an increase in production cost.

Ni is the main element of the above substances, constituting the portion remaining after the above-described auxiliary elements are excluded. Here, when Ni content is less than 58% by mass, it is difficult to ensure the desired high temperature oxidation resistance. On the other hand, in view of respective minimum quantities of auxiliary elements, the Ni content can not be over 71% by mass.

As a Ni alloy having the above-described composition, Inconel 601 can be used. The standard composition thereof is Ni: 60.5% by mass, Cr: 23% by mass, Al: 1.5% by mass, Fe: 14.1% by mass, Mn: 0.5% by mass, Si: 0.2% by mass and C: 0.05% by mass.

Further, in the case where $\Delta\alpha$ is over $5.7\times10^{-6}$/K, when a severe heat cycle is applied, sufficient peeling resistance of the noble metal wear resistant portion can not be ensured. The linear expansion coefficient $\alpha2$at 800 K of the electrode base material having an alloy composition in the above-described range is ordinarily confined in a range of from $15.2\times10^{-6}$/K to $15.4\times10^{-6}$/K (for example, $15.3\times10^{-6}$/K in the case of Inconel 601). On the other hand, although the linear expansion coefficient $\alpha1$ at 800 K of the noble metal wear resistant portion is smaller than the linear expansion coefficient $\alpha2$ of the electrode base material, the value of $\alpha1$ varies to a great extent depending on noble metal compositions. Therefore, taking the value of $\alpha2$ of the selected electrode base material (Ni alloy) into consideration, the noble metal composition to be used is selected so as to have a linear expansion coefficient $\alpha1$ which is as close as possible to the value of $\alpha2$.

The noble metal wear resistant portion may be made with any type of metal element as a main component so long as it is a noble metal (that is, having a noble metal content therein of 50% by mass or more) and, also, among metal elements ordinarily called noble metals, any metal element having a relatively high melting point (such as Pt, Ir, Rh, or Ru). Further, $\Delta\alpha$ can be 0; however, when only the noble metal compositions which can sufficiently ensure wear resistance are considered, it is difficult in practice to have a $\Delta\alpha$ value of $0.8\times10^{-6}$/K or less.

Not only in view of the need that $\alpha2$ be brought near $\alpha1$, but also in view of the need that the wear resistance be ensured, it is preferable that the noble metal wear resistant portion has Pt as its main component. In this case, the linear expansion coefficient at 800 K of Pt is $10.3\times10^{-6}$/K. When the noble metal wear resistant portion has Pt as its main component, in order to further enhance wear resistance at a high temperature, Pt—Pd—Ru alloy which contains Pd or Ru can also be adopted. In this case, as the content of Ru becomes lower, $\alpha1$ becomes smaller (that is, $\Delta\alpha$ becomes larger) whereupon it is necessary to select the content of Ru within a range in which $\Delta\alpha$ is not over $4.55\times10^{-6}$/K. Further, if $\alpha2$ is to be brought to near $\alpha1$, employing a Pt—Ni alloy in which Ni, which exhibits a remarkable action in increasing the linear expansion coefficient, is added to Pt is also effective (for example Pt:Ni is 20% by mass).

Next, the outer diameter of the noble metal wear resistant portion on the ground electrode is, as described above, made to be from 0.6 mm to 1.5 mm. When the outer diameter of the noble metal wear resistant portion is over 1.5 mm, it is difficult to ensure the desired peeling resistance. This is attributable to the increase in the joint interface area of the electrode base material and the noble metal wear resistant portion, generating large displacement along the joint interface by heat expansion/contraction at the time of heating/cooling, whereupon peeling is liable to occur. Thus, by making the above-described outer diameter of the noble metal wear resistant portion 1.5 mm or less, the peeling resistance can further be enhanced whereupon durability of the noble metal wear resistant portion can be ensured even in such a severe use environment as described above. On the other hand, when the outer diameter of the noble metal wear resistant portion is less than 0.6 mm, sufficiently long life of the noble metal wear resistant portion can not be ensured. Further, in the present invention, the outer diameter of the noble metal wear resistant portion is defined by an outer diameter of an orthogonal projection of the noble metal wear resistant portion on a plane perpendicular to a center axis line of the center electrode. Furthermore, in the present invention, the shape of the above-described orthogonal projection of the noble metal wear resistant portion can be a circle but is not limited thereto and can have corners instead.

Additionally, it is preferable that, in order to further enhance peeling resistance of the noble metal wear resistant portion, the size of the noble metal wear resistant portion is adjusted such that S/T is from 0.7 mm to 4.5 mm, wherein T represents thickness of the noble metal wear resistant portion; and S represents the projection area of the noble metal wear resistant portion on a plane perpendicular to the center axis line of the center electrode. When S/T is less than 0.7 mm, the thickness of the noble metal wear resistant portion becomes relatively unduly large and, as a result, when a cooling/heating cycle is applied, stress acting on a joint interface between the electrode base material and the noble metal wear resistant portion becomes large, unfavorably affecting peeling resistance. On the other hand, when S/T is over 4.5 mm, the thickness of the noble metal wear resistant portion becomes unduly small and, as a result, there are some cases in which sufficiently long life of the noble metal wear resistant portion cannot be ensured.

DETAILED DESCRIPTION OF THE PREFERRED EMBODIMENTS

The invention will now be described in further detail by reference to the drawings. However, the present invention should not be construed as being limited thereto.

Figure 1:
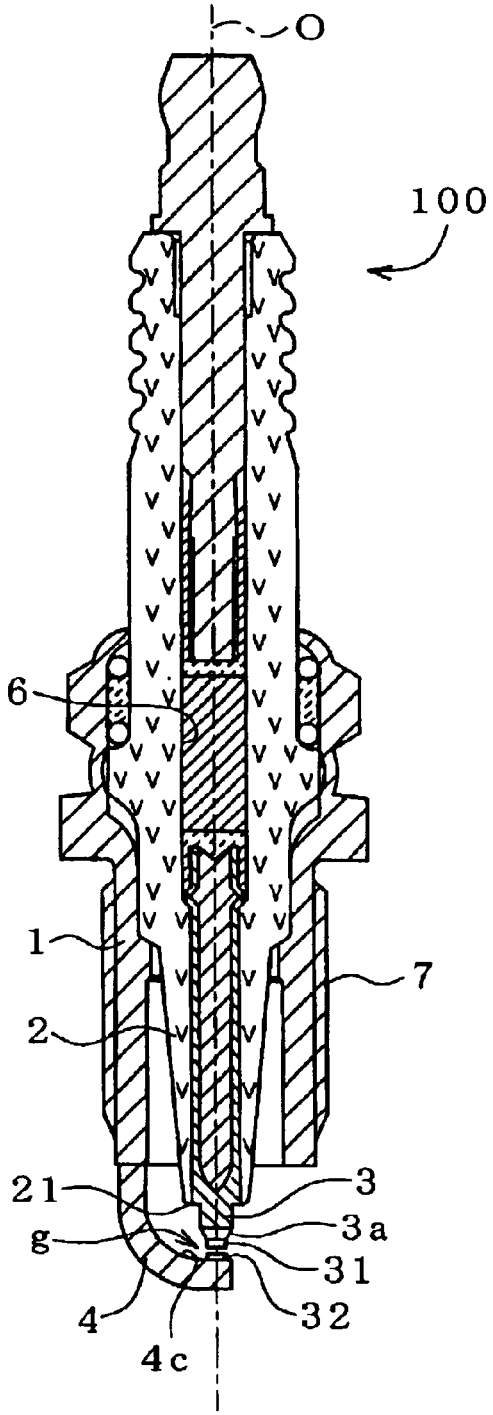
FIGS. 1(*a*) and (*b*) show a front longitudinal cross-sectional view and an enlarged partial cross-sectional view illustrating a spark plug according to an embodiment of the present invention.
Figure 1:
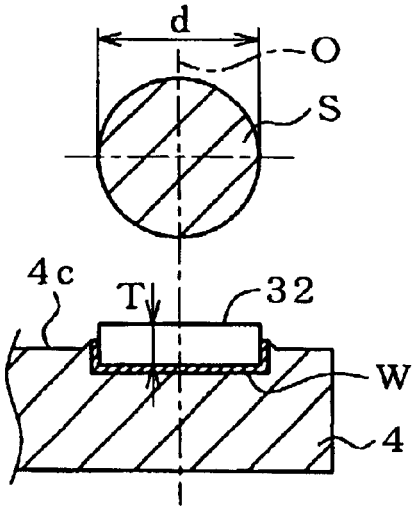

A spark plug 100 shown in FIG. 1(*a*), which is an embodiment of the present invention, comprises a cylindrical metallic shell 1, an insulator 2 imbedded inside the metallic shell 1 such that a front end portion 21 of the insulator 2 protrudes from the metallic shell 1, a center electrode 3 having a center axis line "O" provided inside the insulator 2 with the center electrode in a protruded state and a center electrode noble metal wear resistant portion 31 formed on the front end thereof, and a ground electrode 4 one end of which is joined to the metallic shell 1 by welding or the like and the other end of which is bent sideways such that a side face of the bent end faces the front end portion (in this case, front end surface) of the center electrode 3. Further, a ground electrode noble metal wear resistant portion 32 is formed on the ground electrode 4. The gap formed between the noble metal wear resistant portion on the center electrode and the noble metal wear resistant portion on the ground electrode is designated as spark discharge gap g.

The insulator 2 is constituted by a sintered ceramic such as alumina, aluminum nitride or the like and has a bore portion 6 therein along the axial direction thereof for allowing the center electrode 3 to be inserted therein.

Further, the metallic shell 1, which is formed in a cylindrical shape by a metal such as low-carbon steel or the like, constitutes a housing of the spark plug 100 and, on an outer circumferential face thereof, a thread portion 7 for allowing the spark plug 100 to be secured to an engine block (not shown) is provided.

In the center electrode 3 and the ground electrode 4, electrode base material portions comprising at least the surface layer portion are constituted by a Ni alloy. The electrode base material on the part of the center electrode 3 is constituted by the Ni alloy such as Inconel 600 or the like while the electrode base material on the part the ground electrode 4 is constituted by the Ni alloy of the present invention (for example, Inconel 601).

As shown in FIG. 1(*a*), the front end portion 3*a* of the center electrode 3 is constituted to have a reduced diameter in a tapering state and a flat front end face. A chip in disc form of the center electrode noble metal wear resistant portion, having an alloy composition as defined for the ground electrode noble metal wear resistant portion of the present invention, is overlapped with the flat front end face. Then, laser beam welding, electron beam welding, resistance welding or the like is performed along the circumference of the joining interface of the thus-overlapped chip to form a welding portion B whereupon the thus-overlapped chip is secured and, as a result, the center electrode noble metal wear resistant portion 31 is formed.

On the other hand, a noble metal chip in disc form appropriate for forming the ground electrode noble metal wear resistant portion 32 is overlapped on a side face 4*c* of the electrode base material of the ground electrode 4. Pressure is applied and maintained, these overlapping portions are clamped on either side by electrodes and, thereafter, an electric current is applied which generates heat. As a result, the noble metal chip is joined to the electrode base material such that, as shown in FIG. 1(*b*), the former is partially embedded in the latter. The formation of the welded portion W in which the noble metal chip and the electrode base material are diffused and alloyed completes the formation of the ground electrode noble metal wear resistant portion 32. However, the ground electrode noble metal wear resistant portion 32 denotes a noble metal-constituting portion excluding the region of the welded portion W (that is, the region which is subjected to an influence of diffusion and alloying). Accordingly, the thickness T of the ground electrode noble metal wear resistant portion 32 also denotes thickness exclusive of this welding portion W.

The ground electrode noble metal wear resistant portion 32 (or a noble metal chip used for formation thereof) comprises, for example, a Pt—Pd—Ru alloy, having a composition which is adjusted such that the above-described difference $\Delta\alpha$ (800 K) in linear expansion coefficients between the noble metal wear resistant portion 32 and the electrode base material is made to be $4.55\times10^{-6}$ or less. Further, an outer diameter d thereof which has previously been defined is adjusted to be from 0.6 mm to 1.5 mm. In the above configuration, peeling resistance of the ground electrode noble metal wear resistant portion 32 formed by joining the above-described noble metal chip to the electrode base material is improved to a great extent. Further, from the standpoint of enhancement of peeling resistance, it is preferable that the ratio S/T, where T is the thickness of the ground electrode noble metal wear resistant portion 32 and S is the area of projection of the same on a plane perpendicular to the center axis line of the center electrode, is from 0.7 mm to 4.5 mm.

Further, from the standpoint of enhancement of peeling resistance, the ground electrode noble metal wear resistant portion 32 is preferably formed such that, as shown in FIG. 1(*b*), it is partially embedded in the electrode base material. On this occasion, in order to facilitate resistance welding to be performed while the noble metal chip is being partially embedded in the electrode base material, it is advantageous that the electrode base material is made of an Ni alloy which is softer than the noble metal chip.

According to the present invention, a passive film is formed on the above-described Ni alloy for use in the electrode base material of the ground electrode 4 to enhance oxidation resistance of this surface. Further, when the quantity of Cr is increased and Al is added in substantial amounts to the Ni alloy, the passive film to be formed becomes solid and stable and, as a result, high temperature oxidation resistance is enhanced thereby contributing to the durability of the electrode. Furthermore, since length of the ground electrode 4 can be increased, spark discharge at a position nearer to the center of the combustion chamber than that of the prior art can be performed whereupon, along with an effect of enhancement of peeling resistance of the noble metal wear resistant portion 32, stabilization of combustion is possible.

Figure 2:
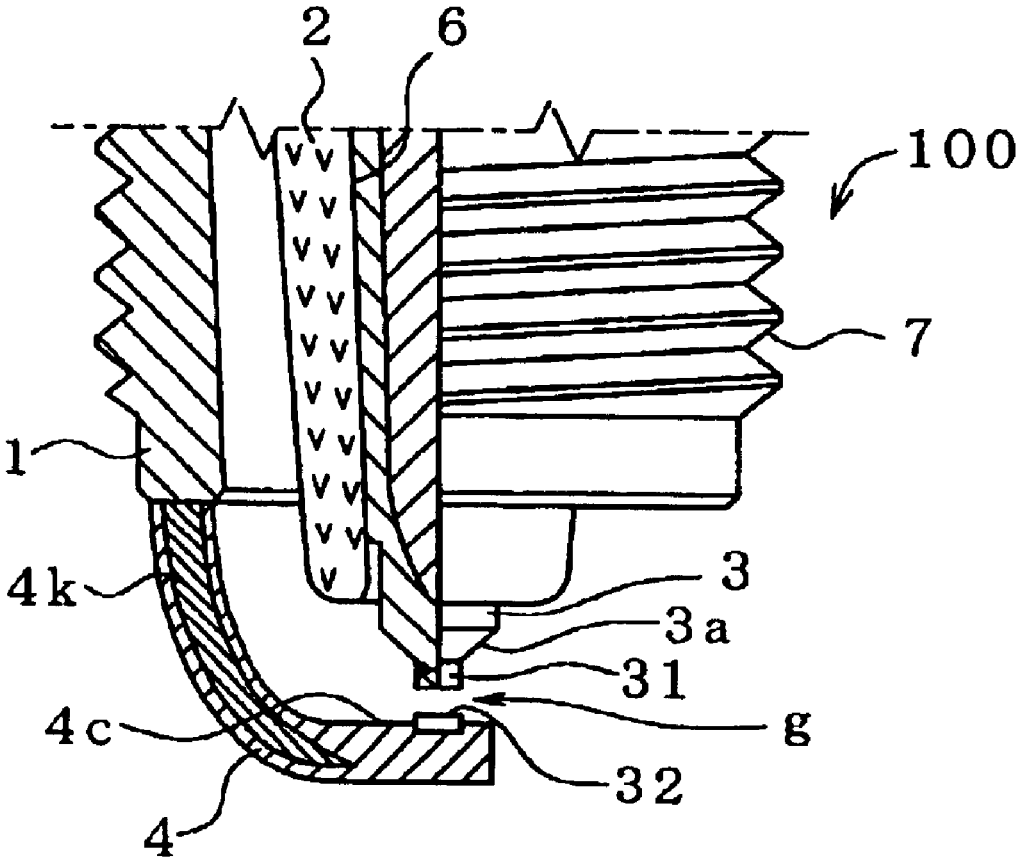
FIG. 2 is an enlarged partial cross-sectional view illustrating a modification of a spark plug according to another embodiment of the present invention.

Further, in order to ensure durability in the prior art, heat dissipation has been achieved by embedding a heat radiation enhancement portion comprising a metal such as Cu or the like which is excellent in heat conductivity compared with Ni inside the ground electrode 4. This keeps the electrode temperature low even when the temperature inside the combustion chamber is elevated. However, by adopting the above-described Ni alloy as the electrode base material, sufficient strength and oxidation resistance can be ensured even when the electrode temperature is elevated to some extent whereupon such embedding of the heat radiation enhancement portion is not always required. As a result, production cost of the spark plug is reduced. On the other hand, as shown in FIG. 2, it is also possible to embed the heat radiation enhancement portion 4*k* inside the ground electrode 4 comprising the above-described Ni alloy. In the above configuration, the spark plug which can operate well in yet a more severe environment can be realized.

The following examples are given to illustrate the invention and should not be interpreted as limiting it in any way. The following experiment was performed to confirm the effect of the present invention.

EXAMPLES

A noble metal chip for forming a noble metal wear resistant portion on the ground electrode was prepared as follows.

Firstly, Pd 10% by mass and Ru in a range of from 0 to 20% by mass, based on 100% by mass of Pt, were mixed each to a predetermined quantity of Pt and melted to prepare Pt—Pd—Ru alloy ingots and Pt—Pd alloy ingots having various compositions. Each of these alloys was subjected to hot forging at 1500° C. and, subsequently, hot rolling and hot swaging at 1300° C. and, then, hot wire drawing at 1200° C. to obtain an alloy wire rod having a diameter of from 0.5 mm to 1.6 mm. The thus-obtained wire rod was cut perpendicularly to the longitudinal direction to obtain chips in disc form having a diameter of from 0.5 mm to 1.6 mm and a thickness of 0.4 mm. The thus-obtained chips were each resistance welded to a side face (width being 2.7 mm) of a ground base material made of Inconel 601 to achieve a joint constitution at a part of the ground electrode with a configuration as shown in FIG. 1(*b*). Further, conditions of resistance welding were set to be applied current: 900A and applied load: 2.45 MPa.

Further, in order to measure linear expansion coefficients at 800 K of alloys having various compositions and Inconel 601, test specimens each having a width of 5 mm, a length (L0) of 5 mm and a height of 20 mm (all being sizes at 273 K) were separately prepared. Then, changes of the size L in a lengthwise direction with changes in temperature were measured by using a known dilatometer and, concurrently, the value $\alpha \equiv (1/L0) \cdot dL/dT$ was calculated as the coefficient at 800 K, wherein $\Delta L$ represents a value of size changes between 773 K and 873 K; $\Delta T$ represents temperature range; and $dL/dT$ is the value obtained by dividing $\Delta L$ by $\Delta T$. As a result, the linear expansion coefficient $\alpha 1$ of Inconel 601 was $15.3 \times 10^{-6}$/K. Further, the linear expansion coefficient $\alpha 2$ of each alloy is shown in Table 1 in terms of $\Delta\alpha$ ($=\alpha 1-\alpha 2$).

Next, for part of the center electrode 3, a noble metal chip having a composition of Ir-5% by mass in proportion to Pt, a diameter of 0.6 mm and a thickness of 0.8 mm was prepared in a same manner as in the above-described ground electrode chip and, then, the thus-prepared noble metal chip was joined to the front end face of the center electrode base material made of Inconel 600 by performing laser welding on the whole periphery thereof. Thereafter, a spark plug specimen having a configuration as shown in FIG. 1 was prepared by using the resultant noble metal-joined ground electrode and center electrode whereupon peeling resistance of the noble metal wear resistant portion on the part of the ground electrode was evaluated using the thus-prepared spark plug specimen.

Procedures for evaluating the peeling resistance are as follows:

First, a cycle in which a front end portion of a spark plug at the spark discharge gap is heated at 1000° C. for 2 minutes by a gas burner and then air cooled for one minute is repeated 1000 times. Next, the specimen is cut by a plane on which lies the center axis line of the noble metal wear resistant portion on the ground electrode, polished, and observed under a microscope by which the length of cracks which developed in the interface between the noble metal wear resistant portion and the electrode base material is measured on the viewing field of the microscope. Then, peel development rate is calculated by dividing the thus-measured crack-developed length by a total length of the interface. The specimen having a peel development rate of more than 50% is evaluated as poor (X) while that having a peel development rate of 50% or less is evaluated as good (O).

Table 1 shows peeling resistance evaluation results when the diameter and the thickness T of the noble metal wear resistant portion are fixed to be 0.9 mm and 0.4 mm, respectively, and the material thereof is of various types, as well as measured values of $\Delta\alpha$. Table 2 shows the peeling resistance evaluation results when the material of the noble metal wear resistant portion is Pt, Pd 10% by mass, and Ru 5% by mass while the thickness T thereof is set to be 0.4 mm and the diameter thereof is changed to various values within a range of from 0.5 mm to 1.6 mm, as well as the values of the above-described S/T.

TABLE 1

| | Peeling resistance | Difference in linear expansion coefficients at 800 K $\Delta\alpha(\times 10^{-6})$ |
|---|---|---|
| Pt-10Pd | X | 4.58 |
| Pt-10Pd-5Ru | ○ | 4.55 |
| Pt-10Pd-10Ru | ○ | 4.52 |
| Pt-10Pd-15Ru | ○ | 4.49 |
| Pt-10Pd-20Ru | ○ | 4.46 |

TABLE 2

| Diameter d mm | Thickness T mm | S ($mm^2$) | S/T (mm) | Peeling resistance |
|---|---|---|---|---|
| φ1.6 | 0.4 | 2.01 | 5.03 | X |
| φ1.5 | 0.4 | 1.77 | 4.43 | ○ |
| φ1.2 | 0.4 | 1.13 | 2.83 | ○ |
| φ0.9 | 0.4 | 0.64 | 1.60 | ○ |
| φ0.6 | 0.4 | 0.28 | 0.70 | ○ |
| φ0.5 | 0.4 | 0.19 | 0.48 | X |

From the results shown in Table 1, it is found that, when $\Delta\alpha$ is $4.55 \times 10^{-6}$/K or less, the peeling resistance is good. Further, from the results shown in Table 2, it is found that, when the diameter of the noble metal wear resistant portion is from 0.6 mm to 1.5 mm and S/T is from 0.7 mm to 4.5 mm, the peeling resistance is good.

It should be further be apparent to those skilled in the art that various changes in form and detail of the invention as shown and described above may be made. It is intended that such changes be included within the spirit and scope of the claims appended hereto.

This application is based on Japanese Patent Application No. 2001-335352 filed Oct. 31, 2001, the disclosure of which is incorporated herein by reference in its entirety.

What is claimed is:

1. A spark plug in which a spark discharge gap is formed by a noble metal wear resistant portion secure to a side face of a ground electrode so that the noble metal wear resistant portion faces the front end face of a center electrode to define said spark discharge gap therebetween, wherein:

at least said side face of said ground electrode comprises an Ni alloy containing from 21% to 25% by mass of Cr, from 1% to 2% by mass of Al, 7% to 20% by mass of Fe, and 58% to 71% by mass of Ni;

said noble metal wear resistant portion is joined to the side face of said ground electrode via a welding portion;

$\Delta\alpha \equiv \alpha 2 - \alpha 1$ is $4.55 \times 10^{-6}$/K or less, wherein $\alpha 1$ represents the linear expansion coefficient at 800 K of the noble metal constituting said noble metal wear resistant portion; and $\alpha 2$ represents the linear expansion coefficient at 800 K of said Ni alloy constituting at least said side face of said ground electrode; and the outer diameter of said noble metal wear resistant portion, which is defined as a diameter of a circle having a same surface area as that of an orthogonal projection of said noble metal wear resistant portion on a place perpendicular to a center axis line of said center electrode, is in the range of from 0.6 mm to 1.5 mm.

2. The spark plug as claimed in claim 1, wherein the size of said noble metal wear resistant portion is such that S/T is in the range of from 0.7 mm to 4.5 mm, wherein T represents thickness of said noble metal wear resistant portion; and S represents an orthogonal projection area of said noble metal wear resistant portion on a plane perpendicular to the center axis line of said center electrode.

3. The spark plug as claimed in claim 1, wherein the noble metal wear resistant portion is joined to the side face of the ground electrode by resistance welding.

4. The spark plug as claimed in claim 1, wherein the Ni alloy contains from 1.5% to 2% by mass of Al.

* * * * *